United States Patent [19]

Clarke

[11] 3,984,035

[45] Oct. 5, 1976

[54] MANUALLY CONTROLLABLE, PRESSURE OPERATED CLOSURE

[76] Inventor: Robert E. Clarke, 1410 Saratoga Drive, Bel Air, Md. 21014

[22] Filed: June 13, 1974

[21] Appl. No.: 478,846

[52] U.S. Cl. ..... 222/497

[51] Int. Cl.[2] ..... B65D 5/72

[58] Field of Search ..... 222/490–497, 222/521, 525, 499

[56] References Cited

UNITED STATES PATENTS

| | | | |
|---|---|---|---|
| 2,314,538 | 3/1943 | Hollenbeck | 222/490 X |
| 3,297,212 | 1/1967 | Neuner | 222/521 |
| 3,545,682 | 12/1970 | Beard | 222/494 X |
| 3,549,060 | 12/1970 | Smylie | 222/521 X |
| 3,777,948 | 12/1973 | Hafele | 222/497 |

*Primary Examiner*—Allen N. Knowles
*Assistant Examiner*—Hadd Lane
*Attorney, Agent, or Firm*—J. Wesley Everett

[57] ABSTRACT

A closure unit for compressible containers and other types of fluid outlets wherein the container is provided with an extension having an opening leading from the container to the extension upon which the closure unit is supported. The closure unit is provided with a fixed stem centrally located of the extension and a separate flexible closed-end sleeve having a central opening through the closed end adapted to overlie the extended portion of the container and the stem, and to be axially movable relative to the stem. The sleeve is provided with a rigid outer side portion and an outer end portion of which at least a portion is provided with a predetermined amount of elasticity. The central opening in the sleeve is slightly less in diameter than the outer end of the stem and when in its outer position will rest lightly on the top of the stem and will flex outwardly to allow the container contents to pass about the stem and out through the opening when pressure is applied to the container, and when the sleeve is in its inward position the sleeve is forced inwardly over the outer end of the stem to provide a definite closure for the opening in the container.

4 Claims, 10 Drawing Figures

MANUALLY CONTROLLABLE, PRESSURE OPERATED CLOSURE

The present invention relates to a fluid closure for compressible containers or other outlets through which a fluid may pass.

One object of the invention is to provide a combination closure and valve through which a fluid, or plastic composition, may be dispensed. This combination closure and dispensing valve is accomplished by providing a stem fixed to the container, or an associated part of the container wherein the container is provided with an extension and an opening leading to the extension through which the contents carried by the container may be dispensed. Over the container opening and stem there is provided a sleeve having a flexible closed end and a central opening therein slightly smaller than the outer end of the stem which when in one position rests lightly upon the outer end of the stem to normally close the opening when no pressure is applied to the contents within the container. When pressure is applied to the contents, the sleeve is forced outwardly from the outer end of the stem allowing the contents to move through the sleeve opening about the outer end of the stem, and when in another position the sleeve is forced downwardly on the outer end of the stem to provide a definite closing of the opening.

Another object of the invention is to provide a closure in which it is not necessary that the closure be re-removed to dispense the contents.

A further object of the invention is to provide simple and efficient means for positioning the sleeve in both its dispensing position and its closed position.

While several objects of the invention have been noted, other objects, uses and advantages may become apparent as the nature of the invention is more fully disclosed in the following description with reference to the accompanying drawings, in which.

Figure 1:
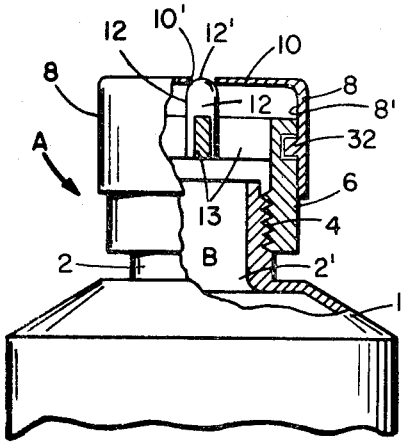
FIG. 1 is a view of the closure partly in elevation and partly in section showing the closure provided with a closed-end sleeve having a central opening therein and a fixed stem carried by the closure or the container for normally closing the sleeve opening when the contents are not under pressure.
Figure 2:
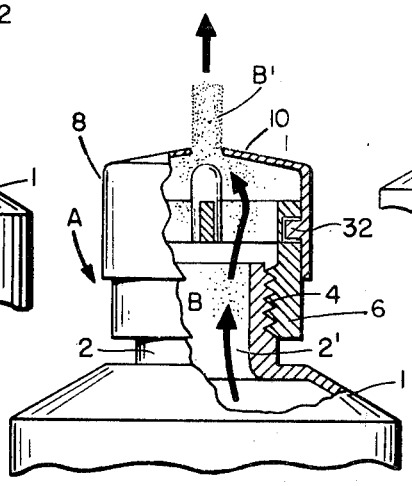
FIG. 2 is a view partly in elevation and partly in section similar to FIG. 1 showing the position of the sleeve when pressure is being exerted on the contents forcing the contents out of the sleeve opening about the stem.
Figure 3:
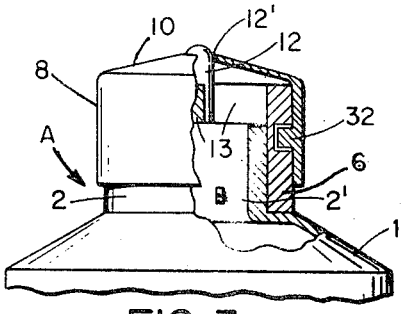
FIG. 3 is still a further view partly in elevation and partly in section showing the sleeve forced inwardly over the outer end of the stem to close the sleeve opening against the dispensing of the contents.
Figure 10:
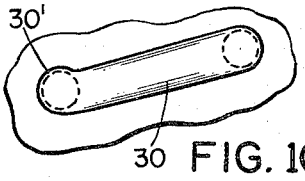
FIG. 10 is an enlarged fragmentary view showing the method of moving the sleeve to its in and out position and a locking means for the sleeve when the sleeve is in its innermost position.

Referring to the drawings in more detail, FIGS. 1, 2 and 3 show one particular form of the invention. 1 represents a conventional pliable container such as is generally used for tooth paste and products of similar consistency. The container is provided with an extension 2, and an opening 2′ leading into the extension 2 over which is secured a closure unit A. In this form the closure unit is secured to the container 1 by a thread 4. The closure unit A is in two parts, a fixed body portion 6 and a rotatable closed-end sleeve member 8. The inner surface 8′ of the inner portion of the sleeve fits closely about the portion 6, and the outer portion 10 of the sleeve is of elastic construction allowing for a predetermined amount of in-and-out movement of the closed end portion of the sleeve. There is provided a fixed rigid stem 12 having an arcuated outer end 12′ supported upon fixed members 13. The closed end portion 10 of the sleeve is provided with a small central opening 10′. The sleeve 8 is movable axially of the body portion 6 of the closure by rotating the same, which operation will be referred to more in detail hereinafter.

The position of the sleeve in FIG. 1 shows the edge of the opening 10′ of the sleeve resting lightly upon the outer end 12′ of the stem 12 which will normally prevent the contents B from escaping through the opening 10′ so long as no pressure is applied to the container contents.

FIG. 2 shows the position of the outer end of the sleeve when the container is compressed exerting pressure on the contents. When pressure is applied to the contents it will cause the elastic outer end portion 10 to move slightly upwardly for a predetermined distance allowing the contents to escape through the opening 10′ as illustrated at B′ in FIG. 2.

FIG. 3 shows the sleeve 8 when it is moved downwardly on the outer end 12′ of the stem 12 to cause the outer end of the stem to block the opening 10′ in the sleeve to provide a complete closure of the opening 10′ even when pressure is applied to the contents. In this position the elasticity in the end portion 10 of the sleeve is extended to substantially its limit which will cause the opening 10′ to fit snugly about the outer end of the stem.

Figure 4:
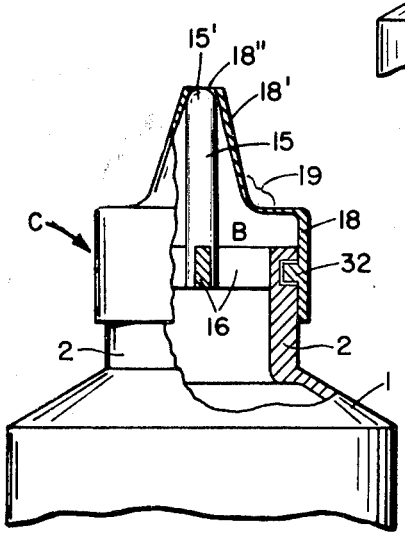
FIGS. 4, 5 and 6 are views partly in elevation and partly in section of a modified form of closure which operates in substantially the same manner as the closure illustrated in FIGS. 1, 2 and 3.
Figure 5:
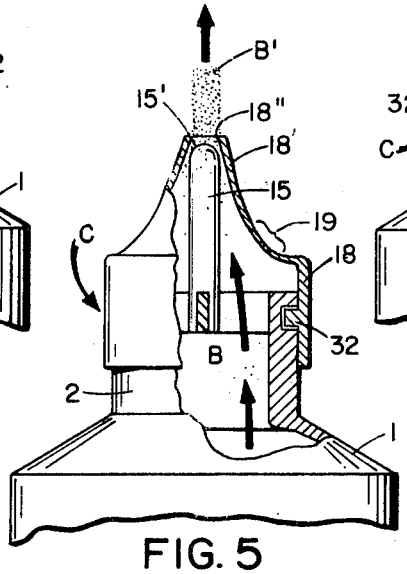
Figure 6:
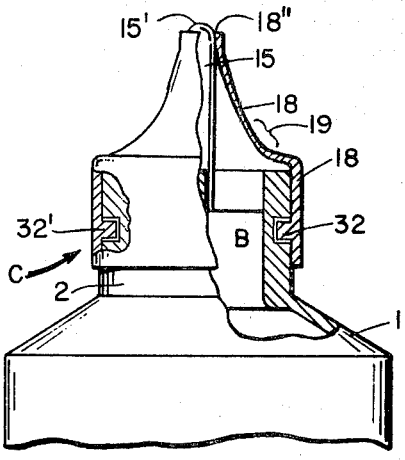

FIGS. 4, 5 and 6 show a closure unit C in a slightly modified form in which the part 6 of the closure is combined with the extension 2 of the container. The sleeve is formed with at least a semi-rigid cylindrical body portion 18 slideably receivable on the extension and an inverted cone-shaped portion 18′ located centrally of the closed end of the sleeve having an opening 18″ at the apex of the cone. The base of the cone is integrally formed with the remaining portion of the closed outer end of the sleeve. The inner portion of the cone and the remainder of the closed outer end, as shown at 19, are made with sufficient elasticity as to allow the end 18″ of the cone to be moved slightly upwardly to allow the ingredients carried by the container to be expelled between the opening 18″ in the apex of the cone and the outer end of the stem 15′, and when moved downwardly to close the said opening 18″ by stretching the sleeve over the outer end of the stem.

Figure 7:
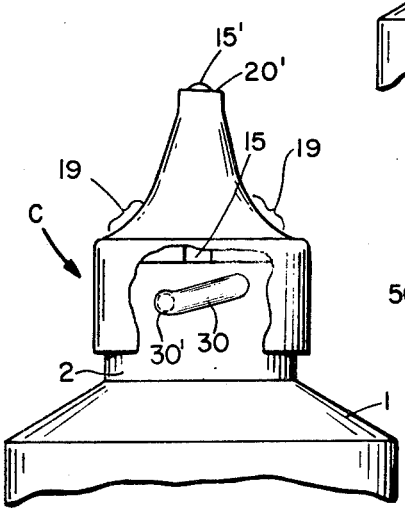
FIG. 7 is a view partly in elevation and partly in section showing a part of the structure for moving the sleeve in and out of the open and closed positions.

FIG. 7 shows the means for moving the sleeves axially of the closure extension. The moving means comprises a diagonal slot 30 formed in each side of the extension 2. Adapted to fit into and slide along these slots, are projections 32 and 32′ carried by the sleeve. When the sleeve is rotated to the left, the sleeves move outwardly as the members 32 and 32', carried by the sleeves, follow the slots 30 in an upwardly direction to a point where there is a minimum amount of pressure on the stem by the rim of the opening 18'' in the sleeve which will allow the sleeve to flex outwardly when pressure is applied to the contents by collapsing the container. This allows the contents to move past the end of the stem 15'. When the sleeve is rotated to the right the sleeve is moved inwardly by the operation of the members 32 and 32' within the slots 30 to cause the opening 18'' to be forced inwardly over the end 15' of the stem to completely close the openings in the sleeve. To lock the sleeve into its innermost position there is provided a socket 30' at the lower end of each of the slots 30. This socket will prevent the members 32 and 32' from moving back along the slot 30 until the sleeve is again rotated to the left to move the members 32 and 32' out of the said sockets and into the angled grooves 30.

Figure 9:
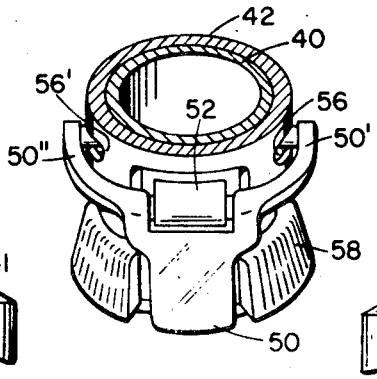
FIG. 9 is a view partly in elevation an partly in section taken on line 9—9 of FIG. 8.
Figure 8:
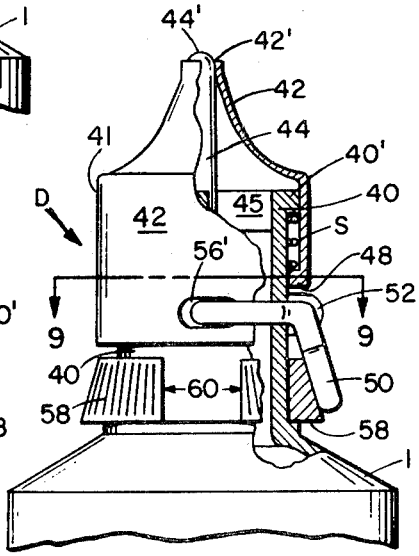
FIG. 8 is a view partly in elevation and partly in section showing still another modification of the closure.

FIG. 8 is still another modified form of closure which may be attached to a container, or tube leading from a container, where it is desired to hand control the dispensing of the contents. This form follows closely the form shown in FIGS. 4, 5 and 6. In this form there is a closure unit D having a stationary extension 40 and a sleeve 41. The sleeve is of the same form as shown in FIGS. 4, 5 and 6, that is, with the inverted cone 42 and the central opening 42'. The extension 40 also supports a stem 44 which is fixed to the extension 40 by cross members 45. The sleeve 41 is provided with an inturned lip 48 and the extension 40 is provided with an outturned lip 40'. Between these two lips is a compression spring S which operates to force the sleeve inwardly on the extension 40 and the stem 44 to normally keep the closure in closed position. To move the sleeve outwardly and off the stem 44 to dispense the contents, there is a finger piece 50 pivotally supported in a fixed bearing 52. The member 50 is provided with a pair of arms 50' and 50'' which are adapted to fit into slots 56 and 56' one on each side of the sleeve 41. Extending about the body 40 of the closure is a rotatable split tapered ring 58, a portion of which is shown in cross-section in FIG. 8. A perspective view of this ring 58 is shown in FIG. 9. The tapered ring 58 is rotatable and when the ring is in the position as shown in FIG. 8 the finger member 50 is forced outwardly from the container which forces the sleeve inwardly and tightly over the end 44' of the stem 44 to fixedly close and lock the opening 42' in closed position. The arm members 50' and 50'' operating within the slots 56 and 56' will force the sleeve outwardly when the finger piece 50 is depressed to cause the sleeve to move outwardly with respect to the top 44' of the stem 44 whereby the contents are dispensed as described for the sleeve C in FIGS. 4 to 7. When the finger piece is released, the spring S moves the sleeve 41 inwardly over the pin 44 whereby the end 44' of the stem 44 will normally close the opening 42' in the sleeve to prevent the escape of the ingredient.

While a specific form of the invention is shown, it is not intended as a limitation as the scope of the invention is best defined in the appended claims.

I claim:

1. In an improved closure unit for a compressible container wherein the container is provided with a circular extension thereon and an opening in the said container leading into the said extension, the improvement which comprises:

a. a circular stem fixedly secured within the extension and extending outwardly therefrom and having an arcuated outer end;

b. a cylindrical sleeve having a rigid side wall and an integrally formed end in said sleeve of limited flexibility, the flexible end having a central circular opening therethrough of a diameter slightly less than the diameter of the outer end of the stem;

c. the diameter of the side wall of the sleeve being such as to slidably engage at least the outer end of the extension;

d. a pair of angled channels positioned diametrically opposite each other on opposite sides of the extension;

e. a pair of projections positioned diametrically opposite each other on each side of the cylindrical sleeve adapted to engage the said channels carried by the extension;

f. the lower ends of the channels having a socket for receiving the said extensions positioned on the sides of the sleeve for holding the extensions in their lower position within the channels;

g. the height of the outer flexible member of the sleeve from the lower ends of the said channels being such as to cause the flexible member of the sleeve to be pressed on the outer end of the stem to a point where no flexibility is left in the flexible end of the sleeve;

h. the outer ends of the angled channels being of such distance from the outer end of the stem wherein the flexible end in the sleeve rests lightly on the outer end of the stem and with sufficient elasticity to allow the material to pass through said opening in the flexible member about the stem when pressure is applied to the material within the container, and to close the opening about the stem when pressure to the material is withdrawn.

2. An improved closure unit for a compressible container as set forth in claim 1, wherein the flexible end of the sleeve is in the form of an inverted cone having its flexible area adjacent the rigid side wall.

3. An improved closure unit as set forth in claim 1 wherein the sleeve is moved by a depressible lever, and a resilient means engaging the sleeve for moving said sleeve.

4. An improved closure as set forth in claim 3 wherein means are provided for locking and unlocking said lever.

* * * * *